US006604869B1

(12) United States Patent
Davis et al.

(10) Patent No.: US 6,604,869 B1
(45) Date of Patent: Aug. 12, 2003

(54) FILM PROCESSOR EFFLUENT HANDLING SYSTEM

(75) Inventors: Michael H. Davis, Ramona, CA (US); Marland Chow, San Diego, CA (US)

(73) Assignee: Phogenix Imaging LLC, San Diego, CA (US)

( * ) Notice: Subject to any disclaimer, the term of this patent is extended or adjusted under 35 U.S.C. 154(b) by 0 days.

(21) Appl. No.: 10/062,997

(22) Filed: Feb. 2, 2002

(51) Int. Cl.[7] ..... G03D 3/02
(52) U.S. Cl. ..... 396/626
(58) Field of Search ..... 396/564, 578, 396/626

(56) References Cited

U.S. PATENT DOCUMENTS 4,641,940 A * 2/1987 Muller et al. ..... 396/622
5,070,351 A * 12/1991 Vanover et al. ..... 396/576
5,109,246 A * 4/1992 Yamamoto et al. ..... 396/607
5,568,220 A * 10/1996 Joos et al. ..... 396/626
6,464,722 B2 * 10/2002 Israel et al. ..... 623/1.17

OTHER PUBLICATIONS

Research Disclosure, Janssen et al., Method for Supplying Processing Liquid and Removing Waste for Potographic Pocessing Machine, Apr. 10, 1998.*

* cited by examiner

*Primary Examiner*—Della Rutledge
(74) *Attorney, Agent, or Firm*—Stephen B. Salai, Esq.; Brian B. Shaw, Esq.; Harter, Secrest & Emery LLP

(57) ABSTRACT

A system for handling effluent from a film processor. A transportable holding tank is attached to the film processor using quick-disconnect fittings, and accepts effluent discharged from the film processor by gravity. The holding tank is uncoupled from the film processor and coupled to a receiving station with quick-disconnect fittings similar to those on the film processor. The effluent is pumped into the receiving station. The system is designed to minimize exposure to film processing chemicals, and handles parallel segregated streams of silver-bearing and non silver-bearing effluent.

42 Claims, 7 Drawing Sheets

FILM PROCESSOR EFFLUENT HANDLING SYSTEM

FIELD OF THE INVENTION

The invention relates to a system for handling effluent such as film processor effluent, and in particular to a system for discontinuously removing such effluent while minimizing unintended spillage of the effluent.

BACKGROUND OF THE INVENTION

In chemical processing, and in particular the processing of photographic film such as that exemplified by the C41 process for silver halide films, the developing process releases silver from the films, leading to a liquid chemical effluent stream rich in silver which is classified as a hazardous material. This effluent stream must be collected and processed to remove the silver or collected and hauled away. Silver must be recovered from the effluent for both environmental and economic reasons.

There are 3 primary systems used today for dealing with effluent from a film processor:

(1) A hard-plumbed system to carry an effluent stream to a centralized effluent collection and/or processing point.

(2) A soft-plumbed system to carry the effluent stream to a nearby collection point. The collection container is then carried to a centralized effluent collection and/or processing location.

(3) A system of on-board holding tanks or containers mounted on the film processor. The tanks must be drained periodically. Typically this draining process consists of installing a temporary drain hose, actuating a manual drain valve and collecting the effluent in an open container. This container is then carried to a centralized effluent collection and/or processing location.

All three systems have shortcomings. While system 1 is operationally ideal, it requires expensive site facility modifications. It is well suited to high volume operations for which the cost of installation is most easily justified. However, it is less suitable for smaller operations. Systems 2 and 3 utilize an "open container" silver recovery unit (SRU) where the effluent is simply poured into an SRU holding tank. These systems can become messy since the containers can be overfilled and spill. Even when no overfilling occurs, systems 2 and 3 can expose an operator to hazardous materials. Also, unintentional introduction of inappropriate liquids such as non-silver bearing effluent (developer) or cleaning supplies or other industrial liquids will damage the SRU. Finally, effluent which contains silver is a potential hazard if allowed to enter a sewer system.

Therefore, there is a need for an inexpensive system of handling silver-bearing effluent from a film processor such that the silver-bearing effluent is isolated thereby reducing risk of exposure to untreated effluent.

SUMMARY OF THE INVENTION

An effluent handling system of the invention includes a holding tank coupled through quick-disconnect fittings to an on-board effluent reservoir on a film processor. The holding tank receives effluent from the effluent reservoir, after which the holding tank and the effluent reservoir are uncoupled. The quick-disconnect fittings are self-sealing, that is, while permitting passage of fluid when coupled, they substantially preclude passage of fluid when uncoupled. The holding tank is transferred to a receiving station whereto it is similarly coupled, and effluent is discharged from the holding tank to the receiving station. The holding tank is then uncoupled from the receiving station and is available for recoupling to the effluent reservoir when required. The invention provides a simple connection between the holding tank and either the effluent reservoir or the receiving station, which substantially precludes unintended leakage or spillage of effluent from the system.

DETAILED DESCRIPTION OF THE INVENTION

In wet photographic processing, an effluent solution is generated which must be removed and treated before final disposal. A film processor 110 such as one that handles the widely used C41 process for silver halide films has two working tanks 112. The film enters one of the working tanks 112 which has developing solution, and is then rinsed and passes into the other working tank 112 containing fixing solution.

The working tanks 112 are replenished as the processor is used. Every 1 to 15 meters of film, fresh concentrated processing solutions and water are added, and spent solutions spill over into on-board effluent reservoirs 114.

Of the spent solutions, the developer is free of silver, and the fixing solution is silver-rich. For both economic and environmental reasons, silver must be recovered from the spent fixing solution. However, any presence of developer would interfere with silver recovery from the fixing solution. Therefore, any system of silver recovery must maintain segregation of the two solutions.

Figure 2:
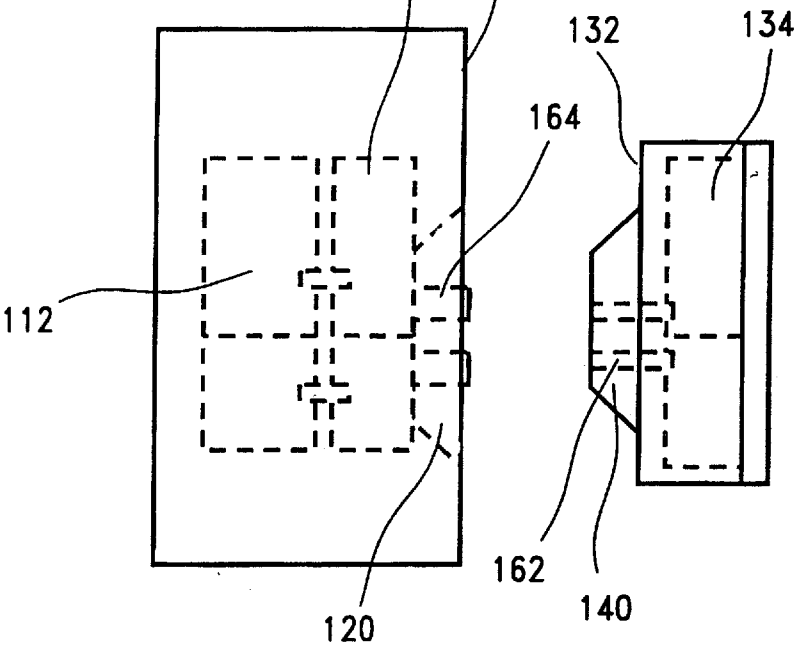
FIG. 2 is the view of FIG. 1, with the effluent handling system with the holding tank uncoupled from the film processor.
Figure 1:
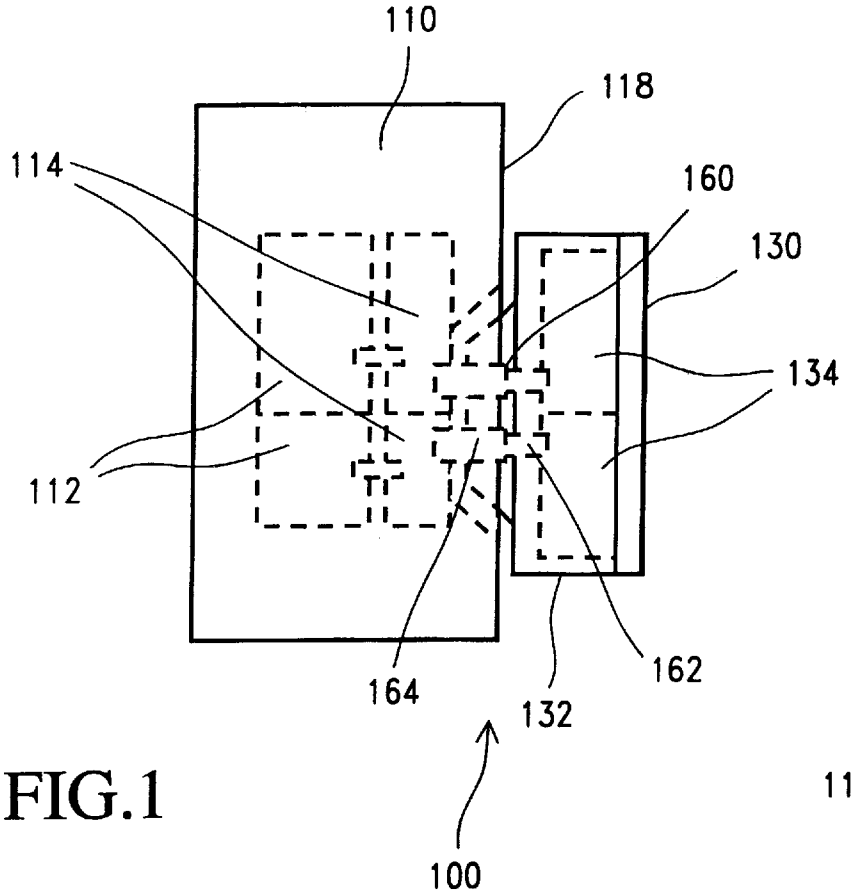
FIG. 1 is a schematic top view of an effluent handling system showing a holding tank coupled to a film processor.

An effluent handling system 100 of the present invention, shown schematically in FIGS. 1 and 2, is intended for transferring spent solution from the effluent reservoir 114 to a receiving station 170 which can for example include a silver recovery unit (SRU) or some precursor thereto. In particular, the invention is intended to substantially preclude any unintended leakage or spillage of effluent.

Figure 3:
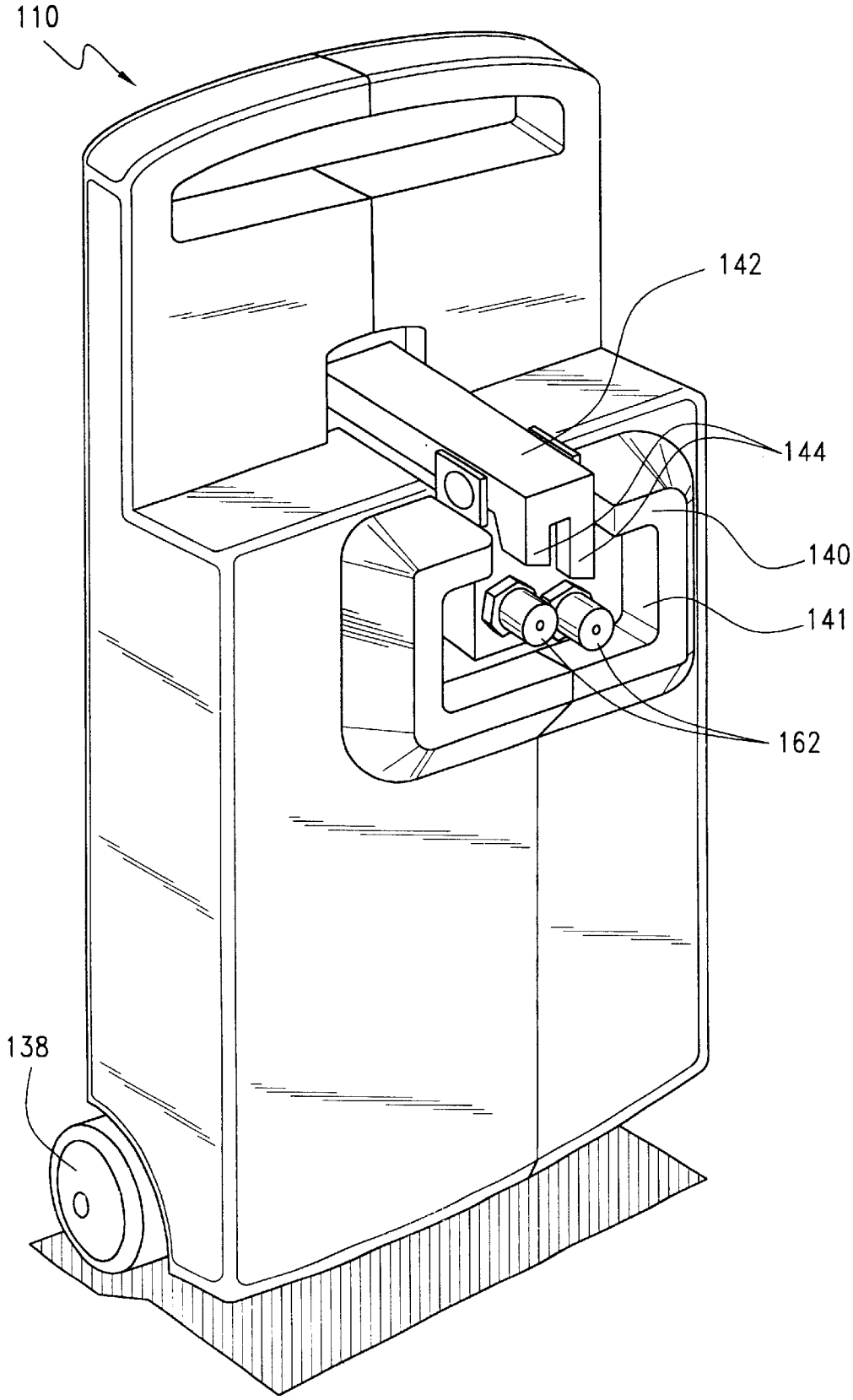
FIG. 3 is a front perspective view of a holding tank in a first embodiment for receiving spent photographic processing fluids from a film processor.
Figure 4:
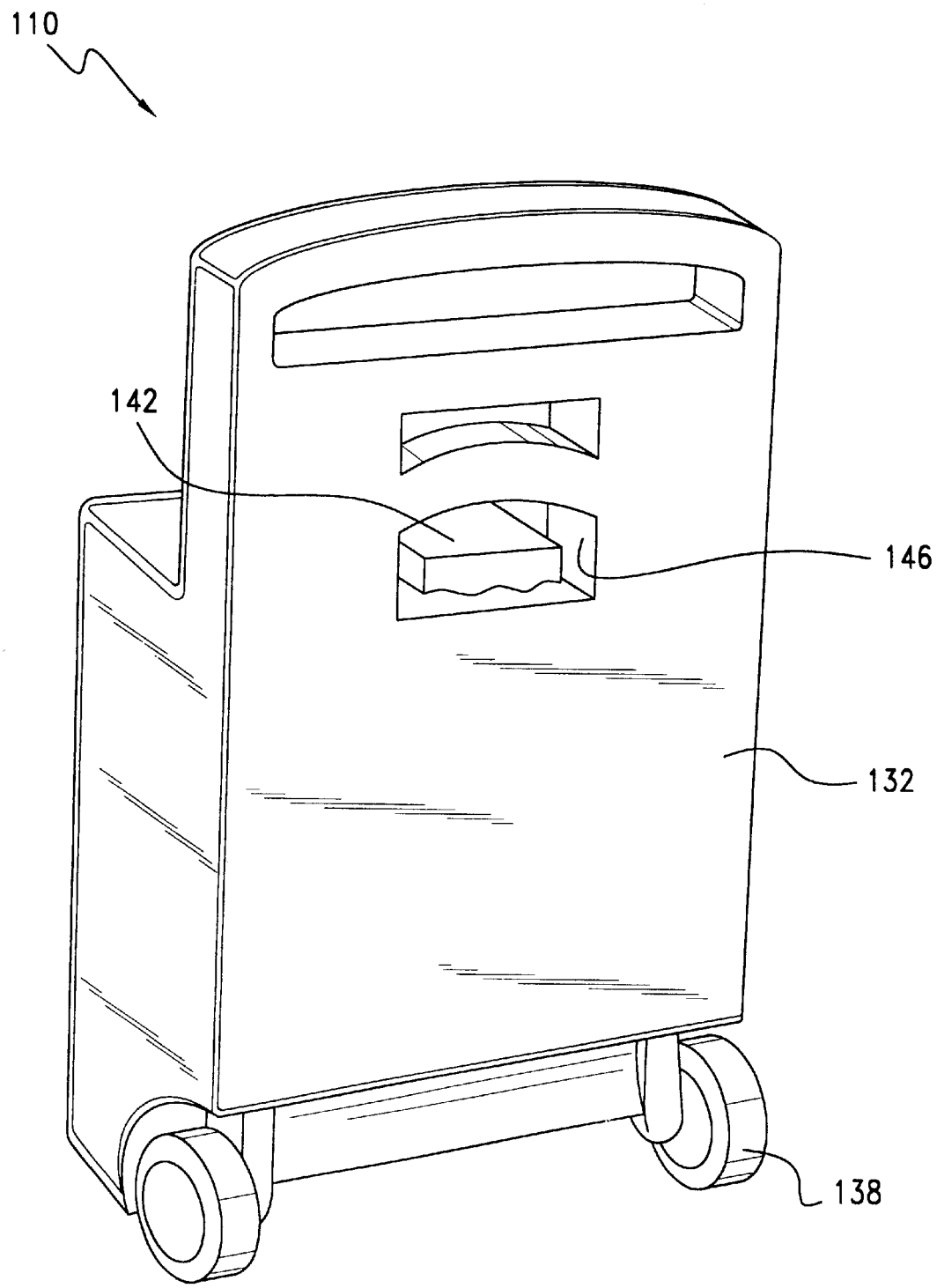
FIG. 4 is a rear perspective view of the holding tank.

The invention includes in particular a holding tank 130 which receives effluent from the effluent reservoir 114, as shown in a first embodiment in FIGS. 3 and 4. The holding tank 130 has a housing 132 and two chambers 134, one for developer and one for fixer. While segregated at all times, the developer and fixer effluents follow parallel paths through the system 100. The holding tank 130 includes a base 136 with supports 138 such as wheels, castors or the like to provide mobility.

The holding tank 130 can be removably coupled to the effluent reservoir 114 by means of fixtures 160, each of which has a first fitting 162 disposed on the holding tank 130 and a second fitting 164 disposed on the film processor 110. Preferably the fittings are male and female quick disconnect fittings, such as those supplied by the Colder Products Company, part numbers HFCD16812 and HFCD22812, either of which could be used as the first and second fitting. For the purposes of this description, it is understood that the first fittings 162 are male quick-disconnect fittings, and the second fittings 164 are the corresponding female quick-disconnect fittings with a release element such as a spring loaded release button 166. Thus, the button 166 is on the film processor 110.

Each first fitting 162 is connected with one of the chambers 134. Each second fitting 164 is disposed near the bottom of the corresponding effluent reservoir 114 so that substantially the entire volume of the effluent reservoir can be emptied by gravity. To allow effectively complete transfer by gravity of the effluent from the effluent reservoir 114, the chambers 134 must be at a lower level than the effluent reservoir 114. The first fittings 162 and the second fittings 164 are aligned so that when the holding tank 130 and the film processor 110 are brought into proximity, the fixtures 160 corresponding with the developing and fixing solution effluents can be readily engaged. It will be apparent that each first fitting 162 is near the top of the corresponding chamber 134.

The holding tank 130 has a projection 140 jutting beyond the general lines of the housing 132. The projection 140 defines a first recess 141 within which the first fittings 162 are substantially located. The film processor 110 has a casing 118, wherein is provided a second recess 120. The second fittings 164 are generally within the second recess 120, that is they do not project significantly outside the general lines of the casing 118. Preferably, the second recess 120 of the film processor 110 and the projection 140 of the holding tank 130 are correspondingly tapered so as to facilitate their alignment and the coupling of the fixtures 160.

When the fixtures 160 are coupled, there is fluid communication between the effluent reservoir 114 and the holding tank 130. The fixtures 160 are self-sealing; that is, passage of fluid is substantially precluded when the first and second fittings 162 and 164 are uncoupled. If the fixtures 160 were not self-sealing, separate shutoffs would be provided.

Engaging the first and second fittings 162 and 164 causes the button 166 to move until the first and second fittings 162 and 164 are properly located, at which point the button 166 reverts to a retaining position so that the first and second fittings 162 and 164 snap together.

In conventional use, the fixtures 160 can be uncoupled by simultaneously depressing the button 166 and pulling apart the first and second fittings 162 and 164. However, in the present invention, the proximity of the holding tank 130 and the film processor 110 renders access to the button 166 difficult. Therefore, a latch mechanism is provided.

Figure 8:
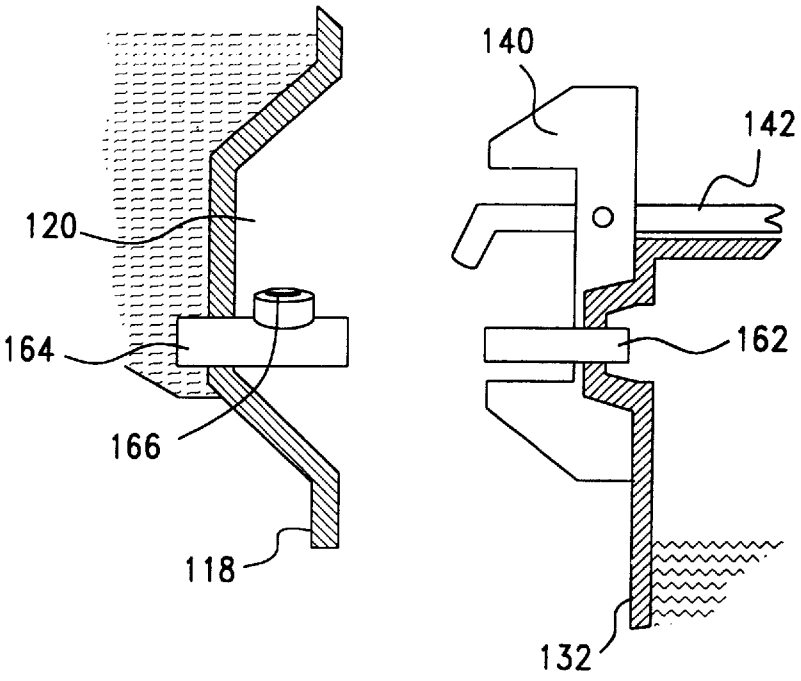
FIG. 8 is a schematic side view showing detail of the holding tank and the film processor in the uncoupled position.
Figure 7:
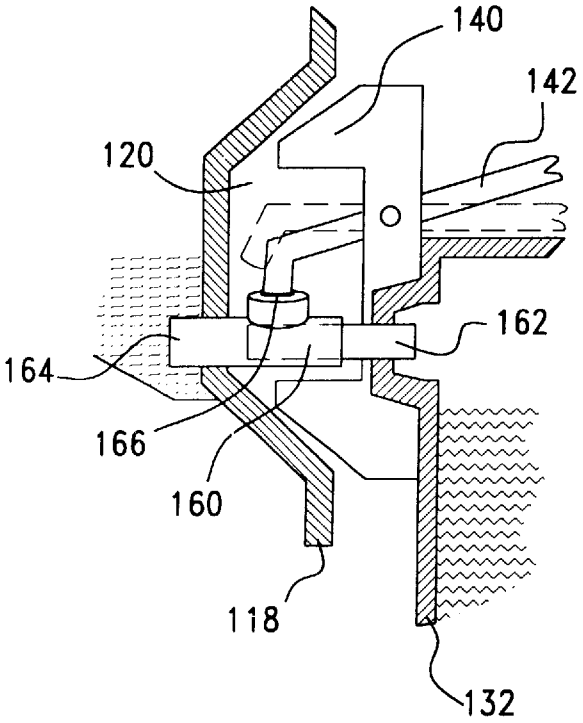
FIG. 7 is a schematic side view showing detail of the holding tank and the film processor in the coupled position.

The first embodiment has a control element such as a spring-loaded lever 142 which is pivotally attached to the holding tank 130, as shown schematically in FIGS. 7 and 8. The lever 142 has a generally horizontal idle position, and an angled active position. The lever 142 is normally retained in the idle position by force from a latch spring (not shown), but is movable to the active position against the opposition of the latch spring. At one end, corresponding with the front side of the holding tank 130, the lever 142 has two downwardly directed prongs 144, each aligned with one of the corresponding fixtures 160. The opposite end of the lever 142 projects through an opening 146 in the housing 132, allowing the lever to be accessed from the rear side of the holding tank 130.

With the fixtures 160 coupled and the lever 142 in the idle position, the prongs 144 are directly above but spaced apart from the buttons 166. When the lever 142 is moved to the active position, the prongs 144 simultaneously depress both buttons 166, thus allowing the fixtures 160 to be uncoupled. Note that in the first embodiment, the buttons 166 are on the film processor 110 and the lever 142 is on the holding tank 130.

Figure 9:
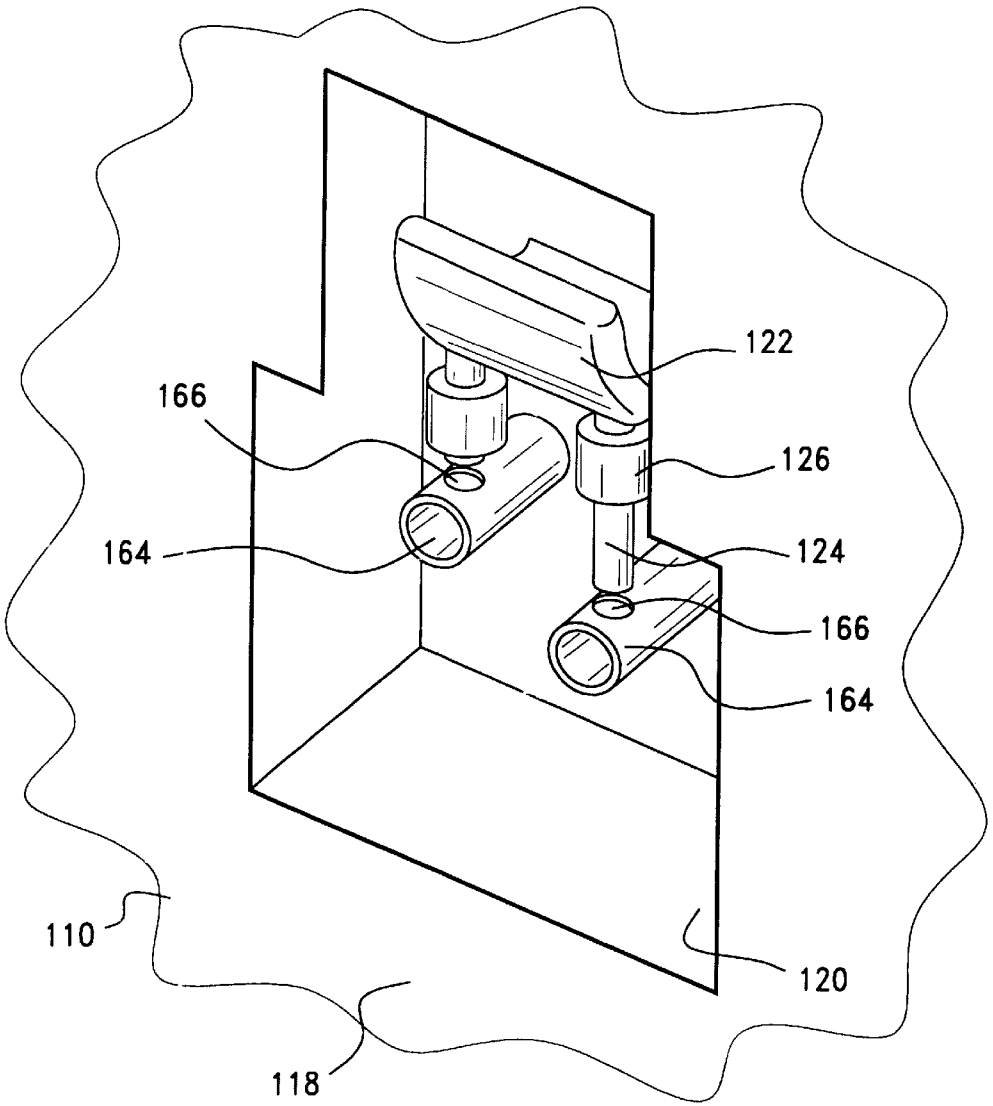
FIG. 9 is a semi-schematic perspective view of a portion of the film processor in a second embodiment of the invention.

In a second embodiment, shown in FIG. 9, the control element is a handle 122 disposed substantially within the second recess 120 of the film processor 110 directly above the buttons 166. The handle 122 abuts the upper ends of a pair of rods 124, each slidably mounted in a holder 126 attached to the casing 118. The rods 124 are spring loaded to retain the handle 122 in an upper orientation, which is the idle position as illustrated in FIG. 9. When actuated, the handle 122 forces down the rods 124 so that they contact and depress the buttons 166, and allow coupled fixtures 160 to be pulled apart.

It is understood that the control elements could be configured accordingly if the release element were disposed on the holding tank 130 rather than on the film processor 110.

Figure 6:
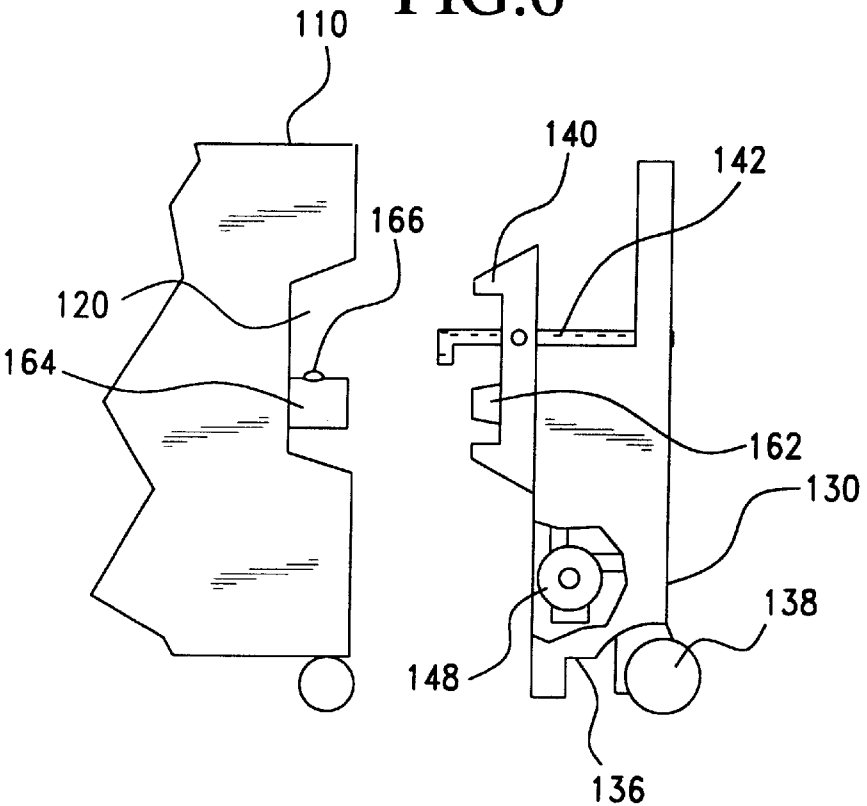
FIG. 6 is a schematic side view of the holding tank and the film processor in an uncoupled position, the holding tank being partially cut away to show a pump.
Figure 5:
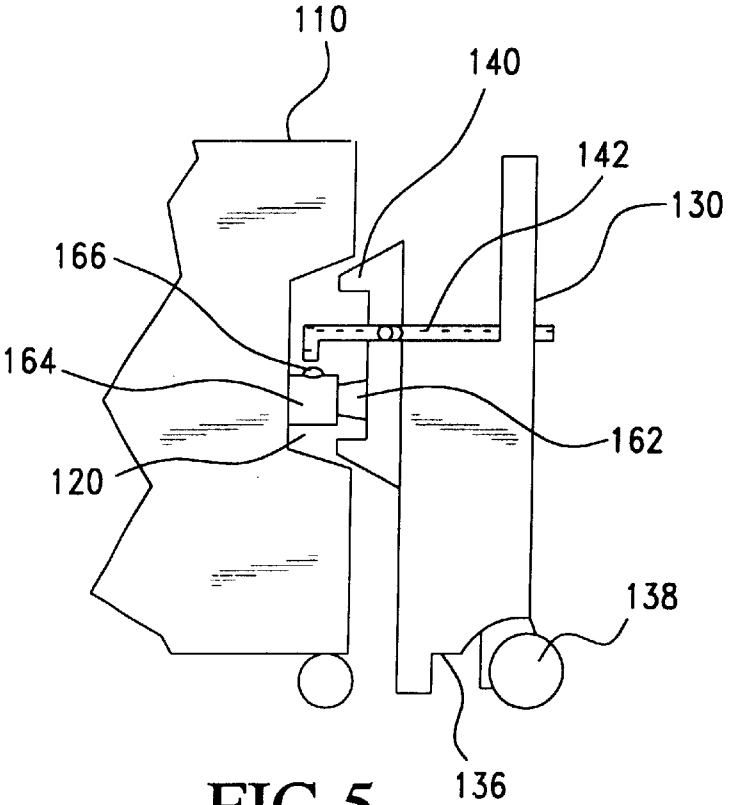
FIG. 5 is a schematic side view of the holding tank and the film processor in a coupled position.
Figure 10:
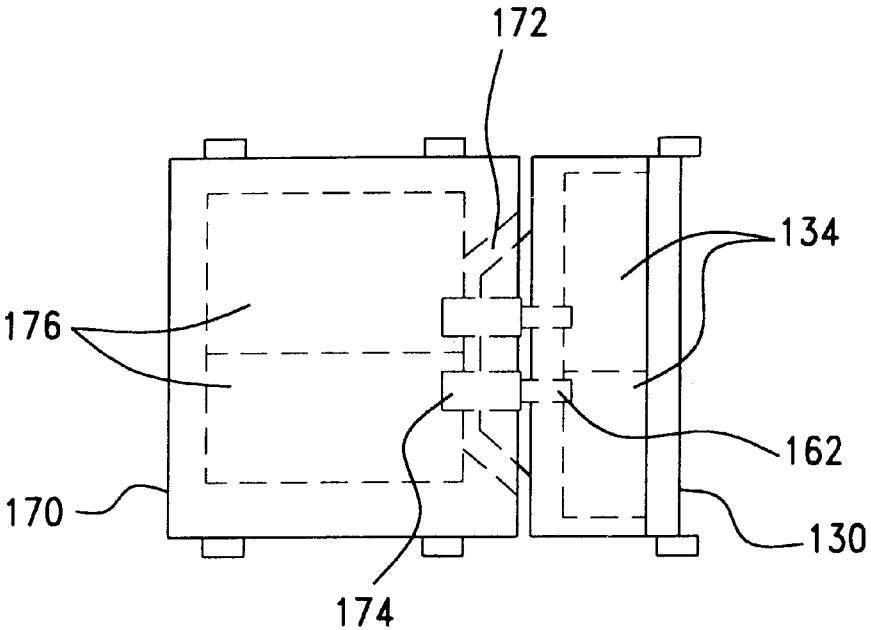
FIG. 10 is a schematic top view of the holding tank coupled to a receiving station.

FIG. 10, the system 100 shows the holding tank 130 coupled to the receiving station 170, which can include a silver recovery unit (SRU) or can be a pumping station that fills certified effluent transport drums that can be hauled away to another site for silver recovery. The receiving station 170 has a third recess 172 and third fittings 174 that are identical to the second fittings 164 and can therefore accept the first fittings 162 in the same way. Unless the receiving station 170 is at a generally lower level than the holding tank 130, gravity cannot be relied on to provide drainage. Therefore, effluent needs to be pumped out of the holding tank 130. Depending on the nature of the receiving station 170, the holding tank 130 has a pump 148 as indicated in FIG. 6, or there may be a pump at the receiving station 170. The receiving station 170 has separate compartments 176 for silver and non-silver bearing effluent.

The relative volumes of the working tanks 112, effluent reservoir 114, and holding tank 130 are important. Clearly, each chamber 134 must have a greater capacity than the corresponding effluent reservoir 114 to preclude overfilling. Preferably, the chamber 134 has a greater capacity than the corresponding effluent reservoir 114 and working tank 112 combined.

While the holding tank 130 has been described as having a wheeled base 136, other configurations may be envisaged. For example, the holding tank 130 could be suspended from a hoist mechanism configured to move along an overhead rail. In this case, the holding tank 130 could be moved both horizontally and vertically.

It can also be envisaged that the holding tank 130 could have additional fittings identical to the first fittings 162 near the bottom of the chambers 134. This would allow effluent to drain from the holding tank 130 to the receiving station 170 under gravity. Of course, it would then be necessary either to elevate the holding tank 130 or locate the receiving station 170 at a lower level.

The holding tank 130 of the invention is predominantly constituted by the housing 132, which is a molded plastic such as high density polyethylene. The fixtures 160 are of plastic coated stainless steel.

The invention is used as follows. When an operator determines that the either effluent reservoir 114 is full (as indicated for example by a level sensor), the operator wheels the holding tank into proximity with the film processor 110, and with the aid of the tapered projection 140, aligns the corresponding first and second fittings 162 and 164. The operator then pushes the holding tank 130 further towards the film processor 110 so that the fixtures 160 snap together. The coupling of the fixtures 160 causes internal valves to open, thus fluidly connecting the effluent reservoir 114 and the holding tank 130, which are configured so that the contents of the effluent reservoir 114 drain into the holding tank 130 under gravity. When drainage is complete, the operator actuates the lever 142 to depress the button 166 of each second fitting 164, and simultaneously withdraws the holding tank 130 from the film processor 110. The operator wheels the holding tank 130 to the receiving station 170 and couples each to the other in the same way as the holding tank 130 was preciously coupled to the film processor 110. The pump 148 is now operated to discharge the contents of the holding tank 130 to the receiving station 170. After completing the pumping operation, the operator uncouples the holding 130 tank from the receiving station 170 by actuating the lever 142. The holding tank 130 is now ready for re-use. Note that in the first embodiment, the operator uses the same lever 142 as before, since it is on the holding tank. Were the second embodiment to be used, a separate control element would be provided at the receiving station 170, identical to the handle 122 on the film processor 110.

While the present system 100 is intended for handling effluent from film processing, it can also be used in the processing of photographic paper. More generally, it could be used to preclude spillage of many types of effluent, whether or not they contain silver—in fact, in a multitude of situations in which it is desired to discontinuously transfer fluid from one vessel to another while precluding significant unintended escape of fluid.

Various features of the present invention have been described with reference to the above embodiments. It should be understood that modification may be made without departing from the spirit and scope of the invention as represented by the following claims.

What is claimed:

1. A film processor effluent handling system comprising:

(a) a holding tank;

(b) a first fitting connected to the holding tank;

(c) an effluent reservoir in the film processor, the effluent reservoir having a second fitting mating to the first fitting; and (d) a receiving station having a third fitting mating with the first fitting.

2. The film processor effluent handling system of claim 1 in which the effluent reservoir is disposed with respect to the second fitting so that the effluent flows out of the second fitting by gravity.

3. The film processor effluent handling system of claim 2 in which the holding tank comprises a pump connected to the first fitting, pumping effluent out of the holding tank into the receiving station.

4. The film processor effluent handling system of claim 3 in which the holding tank is transportable.

5. The film processor effluent handling system of claim 4 in which the holding tank comprises a wheeled base.

6. The film processor effluent handling system of claim 5, in which the first fittings are aligned with the second and third fittings when the holding tank is resting on the wheeled base.

7. The film processor effluent handling system of claim 1, wherein the first recess is defined by a projection.

8. The film processor effluent handling system of claim 7 in which the film processor comprises a second recess engaging the projection and the second fitting is disposed in the second recess.

9. The film processor effluent handling system of claim 8 in which the projection and the second recess are self-aligning for engaging the first and second fittings.

10. The film processor of claim 9 in which the receiving station comprises a third recess and the third fitting is disposed in the third recess.

11. The film processor of claim 10 in which the projection and the third recess are self-aligning for engaging the first and third fittings.

12. The film processor effluent handling system of claim 1 in which the holding tank comprises two chambers, each fluidly connected to a corresponding first fitting.

13. The film processor effluent handling system of claim 12 in which the film processor comprises two working tanks, each fluidly connected to a corresponding second fitting.

14. The film processor effluent handling system of claim 13 wherein the volume of each chamber is greater than the combined volume of the corresponding effluent reservoir plus the volume of the working corresponding tank.

15. The film processor effluent handling system of claim 1 in which all the fittings are quick-disconnect fittings.

16. The film processor effluent handling system of claim 15 having a control element operably connected with a release element on one of the fittings.

17. The film processor effluent handling system of claim 16 wherein the control element is connected to the holding tank.

18. The film processor effluent handling system of claim 16 wherein the control element is connected to one of the film processor and the receiving station.

19. The film processor effluent handling system of claim 1 having a corresponding plurality of fittings on each of the film processor, holding tank and receiving station.

20. The film processor effluent handling system of claim 19, wherein each of the plurality of fittings on one of the film processor, holding tank and receiving station corresponds to a different effluent stream.

21. A film processor effluent handling system comprising:

(a) a holding tank having a first recess;

(b) a first fitting disposed in the first recess and connected to the holding tank;

(c) an effluent reservoir in the film processor, the effluent reservoir having a second fitting mating to the first fitting; and (d) a receiving station having a third fitting mating with the first fitting.

22. A film processor effluent handling system comprising:

(a) a holding tank;

(b) a first fitting connected to the holding tank;

(c) an effluent reservoir in the film processor, the effluent reservoir having a second fitting mating to the first fitting; and disposed with respect to the second fitting so that the effluent flows out of the second fitting by gravity; and (d) a receiving station having a third fitting mating with the first fitting, the receiving station comprises a pump connected to the first fitting, pumping effluent out of the holding tank into the receiving station.

23. A film processor effluent handling system comprising:

(a) a holding tank;

(b) a first self-sealing, quick disconnect fitting connected to the holding tank;

(c) an effluent reservoir in the film processor, the effluent reservoir having a second self sealing, quick disconnect fitting mating to the first self-sealing, quick disconnect fitting; and (d) a receiving station having a third, self-sealing quick disconnect fitting mating with the first fitting.

24. A film processor effluent handling system comprising:

(a) a holding tank;

(b) a first fitting connected to the holding tank;

(c) an effluent reservoir in the film processor, the effluent reservoir having a second fitting mating to the first fitting; and (d) a receiving station having a third fitting mating with the first fitting; and (e) a control element operably connected with a plurality of fitting release elements, the control element selected to actuate the fitting release elements simultaneously.

25. An effluent handling system comprising:

(a) a first vessel having a projection defining a first recess;

(b) a first fitting disposed in the first recess;

(c) a second vessel having a second recess; and (d) a second fitting disposed in the second recess, the second fitting aligned with the first fitting and removably coupled thereto;

the projection and the second recess defining the alignment of the first and second fittings.

26. The effluent handling system of claim 25, wherein the first and second vessels are in fluid communication when the first and second fittings are coupled.

27. The effluent handling system of claim 25, wherein the first and second fittings are self-sealing.

28. The effluent handling system of claim 25, wherein the projection and the second recess are correspondingly tapered.

29. The effluent handling system of claim 25, wherein one of the first and second fittings has a release element.

30. The effluent handling system of claim 29, wherein the release element is operably connected to a control element attached to one of the vessels.

31. The effluent handling system of claim 29, wherein the control element is attached to the same vessel as the release element.

32. The effluent handling system of claim 29, wherein the control element is not attached to the same vessel as the release element.

33. The effluent handling system of claim 25, wherein one of the vessels is transportable.

34. The effluent handling system of claim 33, wherein the transportable vessel has a wheeled base.

35. A method of handling effluent from a film processor, comprising the steps of:

(a) engaging a projection of a holding tank with a recess in the film processor to align a film processor quick-disconnect fitting and a holding tank quick-disconnect fitting;

(b) coupling the quick-disconnect fittings to establish a fluid connection between the film processor and the holding tank;

(c) draining the film processor effluent into the holding tank; and (d) uncoupling the quick-disconnect fittings.

36. The method of claim 35, comprising the additional steps of:

(a) transporting the holding tank to a receiving station;

(b) aligning and coupling the holding tank quick-disconnect fitting and a receiving station quick-disconnect fitting similarly to the previous alignment and coupling of the holding tank and film processor quick-disconnect fittings;

(c) discharging the effluent from the holding tank; and (d) uncoupling the receiving station and holding tank quick-disconnect fittings.

37. The method of claim 36, further comprising substantially precluding fluid passage through uncoupled quick-disconnect fittings.

38. The method of claim 37, further comprising substantially precluding the fluid passage with self-sealing quick-disconnect fittings.

39. The method of claim 36, including operating a control element connected to one of the holding tank, the film processor and the receiving station to actuate a release element on one of the quick-disconnect fittings.

40. The method of claim 36, including discharging the effluent from the holding tank with a pump.

41. The method of claim 40, including mounting the pump on the holding tank.

42. The method of claim 40, including mounting the pump on the receiving station.

* * * * *